United States Patent [19]

Roller

[11] Patent Number: 4,602,671

[45] Date of Patent: Jul. 29, 1986

[54] METHOD FOR OSCILLATING A CONTINUOUS CASTING MOLD

[75] Inventor: Erling Roller, Essen, Fed. Rep. of Germany

[73] Assignee: Fried. Krupp Gesellschaft mit beschränkter Haftung, Essen, Fed. Rep. of Germany

[21] Appl. No.: 677,376

[22] Filed: Dec. 3, 1984

[30] Foreign Application Priority Data

Dec. 1, 1983 [DE] Fed. Rep. of Germany ..... 3343479

[51] Int. Cl.[4] ..... B22D 11/04

[52] U.S. Cl. ..... 164/478; 164/490

[58] Field of Search ..... 164/478, 416, 440, 490

[56] References Cited

U.S. PATENT DOCUMENTS 3,857,437 12/1974 Watts ..... 164/478

FOREIGN PATENT DOCUMENTS 2737835 3/1979 Fed. Rep. of Germany .

3137119 4/1983 Fed. Rep. of Germany .

3148033 6/1983 Fed. Rep. of Germany .

2222156 10/1974 France .

57-187145 11/1982 Japan ..... 164/478

*Primary Examiner*—Kuang Y. Lin

*Attorney, Agent, or Firm*—Spencer & Frank

[57] ABSTRACT

In a method for oscillating an inherently rigid horizontal continuous casting mold for metals, by subjecting the mold to sinusoidally oscillating horizontal stroke movements alternately in the casting direction and in the direction opposite to the casting direction, while casting is advanced in the casting direction and is removed continuously, the mold is oscillated at a frequency, f, of at least about 100 cycles/minute, and the oscillation frequency, f, and mold stroke, H, are given values related to casting rate, $V_0$, such that the average value of $2\ fH/V_0$ is at least 0.64 and the displacement of the mold relative to the casting during each movement of the mold in the casting direction is no greater than 1 mm.

15 Claims, 2 Drawing Figures

METHOD FOR OSCILLATING A CONTINUOUS CASTING MOLD

BACKGROUND OF THE INVENTION

The present invention relates to a method for oscillating an inherently rigid, horizontal, continuous casting mold for metals, particularly steel, with the mold performing sinusoidally oscillating stroke movements alternately in the casting direction and in the direction opposite to the casting direction and the casting being removed continuously.

A method of the above-mentioned type is used, for example, in the horizontal continuous casting system disclosed in DE-OS [Federal Republic of Germany Laid-open Application] 2,737,835.

In this system, the continuous casting mold, together with the reservoir upstream of it, constitutes a movably mounted unit. At its inlet end, the casting cavity of the inherently rigid continuous casting mold has a reduced cross section.

Moreover, the prior art horizontal continuous casting system is equipped with an oscillatory drive with which the amplitude of the stroke movements can be set to between 0 and 5 mm and the mold oscillation frequency can be set to between 0 and 500 cycles per minute.

The prior publication in question does not contain any reference to the way in which the variables of mold stroke, mold oscillation frequency and casting rate—corresponding to the casting removal rate - under discussion here are to be coordinated with one another to arrive at a cast product of sufficient quality, and particularly without flaws in the region of the casting surface.

Generally, horizontal continuous casting molds have the drawback that the resulting castings have a poorer surface quality than those produced in vertical continuous casting molds. This is connected, inter alia, with the use of a break ring disposed between the reservoir and the continuous casting mold. Such ring constitutes a constriction of the casting cavity. Since the formation of a skin on the casting begins at the point where the break ring and the continuous casting mold are connected, the mold has the effect of a piston when it performs an oscillating movement in the casting direction and thus compresses the skin on the casting.

In contradistinction thereto, furnace-independent continuous casting molds—in addition to vertical molds, this also includes circular arc molds—have the effect of a sleeve, i.e. compression of the skin on the casting occurs only until, after overcoming the friction between skin and continuous casting mold, a relative movement begins between these components. In view of this significant difference, the aspects to be considered in the design of vertical or circular are molds cannot be transferred to the conditions encountered during horizontal continuous casting. See, in this connection, DE-OS No. 3,137,119.

SUMMARY OF THE INVENTION

It is an object of the present invention to oscillate a horizontal continuous casting mold operating with continuous casting removal so as to be able to produce a cast product of improved quality at justifiable expense.

A further object of the invention is to produce a casting having neither a scaly surface nor penetrating flaws which would possibly require pretreatment of the casting surface before further processing.

The invention is directed primarily to the processing of steel; however, it can just as well be used for the production of castings of other metals.

The above and other objects are achieved, according to the invention, in a method for oscillating an inherently rigid horizontal continuous casting mold for metals, by subjecting the mold to sinusoidally oscillating horizontal stroke movements alternately in the casting direction and in the direction opposite to the casting direction, while the casting is advanced in the casting direction and is removed continuously. The method according to the invention includes: oscillating the mold at a frequency, f, of at least about 100 cycles/minute; and giving the oscillation frequency, f, and mold stroke, H, values related to casting rate, $V_0$, such that the average value of $2\ fH/V_0$ is at least 0.64 and the displacement of the mold relative to the casting during each movement of the mold in the casting direction is no greater than 1 mm.

The method according to the present invention departs from the procedure long used by those experienced in the art, which is to operate, in spite of the greater cost and engineering efforts, with intermittent casting removal.

Such methods, which operate with a stationary or an additionally moved horizontal continuous casting mold are disclosed, for example, in DE-OS 3,148,033 and 3,137,119. The method of the former publication requires a removal device which permits direct sudden acceleration and deceleration of the casting in extremely fast succession, and this with the removal device being disposed, under certain circumstances, at a considerable distance from the horizontal continuous casting mold.

Although the method of the second-mentioned publication operates without pushing the casting back in the direction toward the horizontal continuous casting mold, it also entails considerable added expenditures, since the casting is subjected to additional, shock-like impulses in the casting direction, for example due to movement of the horizontal continuous casting mold. Insofar as the prior art method operates with superposition of the casting removal and pulsating movement, the horizontal continuous casting mold no longer exhibits any lead.

Prior art statements about the path traversed during the pulse generation do not indicate, aside from the other existing differences, that the maintenance of a negative strip length of the order of magnitude of at most a few tenths of a millimeter is of any significance.

In view of all this, the prior art does not provide any suggestions for solving the problem at hand, and in particular for the solution provided by the present invention which involves departing from the direction that development in the art has taken, and operating with an oscillating horizontal continuous casting mold and continuous removal of the casting.

In detail, the method according to the present invention is based on recognition that a good casting surface can be obtained only if the speed of the horizontal continuous casting mold in the casting direction is greater than the casting speed (corresponding to the casting removal rate). This requirement can be met by coordinating the three variables - mold oscillation frequency, mold stroke and casting speed - with one another, so that an average lead of the continuous casting mold with respect to the casting is held within a minimum value of $2/\pi$, which corresponds to about 0.64.

The lead derives from the relationship between the average mould velocity (2 H f) and the casting rate ($V_o$) which corresponds to the strand withdrawal speed.

Additionally, the three above-mentioned parameters are selected so that the negative strip, i.e. the path traversed by the mold in the casting direction with respect to the casting during the lead of the continuous casting mold, is at most 1 mm, preferably even only 0.1 to 0.5 mm. Moreover, the method according to the invention is preferably implemented in such a manner that the mold oscillation frequency does not fall below a minimum value of about 100 cycles/min.

The lead of the horizontal continuous casting mold with respect to the movement of the casting in the casting direction has the result that the additional skin element formed during an oscillation process is pushed onto the previously formed skin so as to be welded together with that skin. In view of the already mentioned piston effect of the horizontal continuous casting mold equipped with a break ring that is connected upstream, it is proposed that a very small negative strip be maintained. If this strip takes on too high a value, there exists the danger that the compressed skin growth element is pushed underneath or over the subsequent skin; this would lead to undesirable scale formation at the casting surface and/or to damage of the break ring which is made of ceramic material.

Finally, by maintaining a minimum value for the mold oscillation frequency, it is accomplished that the skin growth element formed during the oscillation process experiences only slight through solidification and consequently no deep flaws after it is removed from the break ring.

If, for example due to a change in casting rate, the horizontal continuous casting mold no longer has a lead, there exists, in contradistinction to casting with a vertical continuous casting mold, the considerable danger of a complete break in the casting. If the negative strip of a horizontal continuous casting mold running with a lead is too long, it is impossible to produce a casting having satisfactory surface quality.

In the method according to the present invention, the continuous casting mold preferably employs a minimum ocillation frequency of 120 cycles/min.

The mold stroke performed during an oscillation process should be no more than 6 mm, and preferably no more than 5 mm. Advisably, the method according to the invention is implemented in such a manner that, at the minimum oscillation frequency of 120 cycles/min, the mold stroke is set to be only 2 to 4 mm.

By maintaining a certain minimum oscillation frequency in connection with a short mold stroke, the danger of deep flaws at the casting surface can be reduced considerably.

In order to produce operating conditions during the casting process—excepting at most the period immediately after casting begins and immediately before the end of casting—which make it possible to produce a casting of sufficient quality, the present invention further coordinates the three variables of mold oscillation frequency, mold stroke and casting rate in dependence on the latter so that the minimum lead value as well as the maximum negative strip are maintained. This can be accomplished in that the respective values are derived by a process computer.

Consequently, a horizontal continuous casting mold suitable for implementation of the process of the invention includes an oscillatory drive which can be set to the required ranges of mold oscillation frequency and mold stroke. Moreover, the associated casting removal drive must be designed in such a manner that the removal speed, which is represented by the casting rate, can be varied over a sufficiently wide range.

For the continuous horizontal casting of, for example, billets and blooms of steel, casting rates of about 1.5 to 4 m/minute are presently applicable.

DESCRIPTION OF THE PREFERRED EMBODIMENTS

Figure 1:
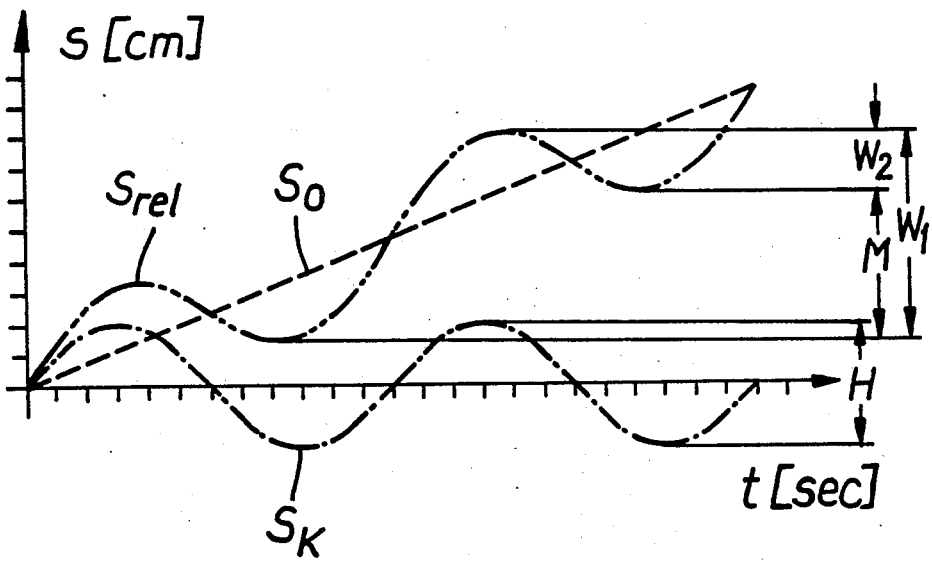
FIG. 1 shows in the form of a displacement vs. time diagram the parameters which are of importance for the operation of the process according to the invention and for the strand produced thereby.

The parameters required for the implementation of the present invention and thus for the castings produced thereby, are shown in the sole Figure and the following equations, where f=mold oscillation frequency H=mold stroke=path between two reversal points t=time $V_0$=casting rate=casting removal speed, and S represents displacement.

Thus, for a horizontal continuous casting mold employing sinusoidal oscillations, the following relationships apply:

Displacement of casting: $S_0=V_0t$

Mold displacement: $S_k=0.5\cdot H \sin 2\pi ft$

Mold speed: $V_k=\pi fH\cdot\cos 2\pi ft$

Displacement of casting relative to displacement of mold: $S_{rel}=V_0\cdot t+0.5H \sin 2\pi ft$, Positive strip length, between minimum and maximum of $S_{rel}$ during one half cycle:

$$W_1=\frac{V_0}{\pi f}\cdot\arccos\frac{-V_0}{\pi fH}+H\sin\left(\arccos\frac{-V_0}{\pi fH}\right)$$

Negative strip length between maximum and minimum of $S_{rel}$ during one half cycle:

$$W_2=W_1-\frac{V_0}{f}\left(\text{where }\frac{V_0}{f}=\text{ the displacement } M \text{ between minima of } S_{rel}\right)$$

$$W_2=\frac{V_0}{\pi f}\cdot\arccos\frac{-V_0}{\pi fH}+H\sin\left(\arccos\frac{-V_0}{\pi fH}\right)-\frac{V_0}{f}$$

Positive S values arise in the region of the $S_{rel}$ curve which corresponds to the positive strip $W_1$. During the positive phase (operative strip $W_1$) the strand covers a positive distance in casting direction relative to the continuous casting mold. During the negative phase (negative strip $W_2$) the strand covers a negative distance in casting direction relative to the continuous casting mold and is compressed. For this reason a negative S value is to be allocated to the region $W_2$.

EXAMPLES

With a casting rate of $V_0=1.5$ m/min, a mold stroke of H=5 mm and a mold oscillation frequency of f=100 cycles/min, the positive and negative strip lengths are of the required order or magnitude. If the mold oscillation frequency were dropped to less than 100 cycles/min, no further compression would result for the casting. An increase in the mold oscillation frequency to 150 cycles/min with otherwise unchanged conditions would already result in the negative strip taking on a value above the minimum limit of 1 mm.

With the already mentioned casting rate value $V_0$ and a mold stroke of 4 or 2 mm, respectively, the required values for lead and negative strip can be maintained only if the mold oscillation frequency lies between 120 and 200 cycles/min or is more than 250 cycles/min, respectively.

Increasing the casting rate to $V_0=2.0$ m/min, with the mold stroke set at 6, 5, 4, or 2 mm, respectively, has the result that the mold oscillation frequency must lie in a range between 110 and 150, between 130 and 200, between 160 and 270, or above 320 cycles/min, respectively.

The examples show that with a given casting rate (corresponding to the casting removal rate) and with consideration of the required order of magnitude of lead and negative strip the desired higher values for the mold oscillation frequency can be realized only if the system operates with a relatively short mold stroke. Reduction of the mold stroke, moreover, has the result that the suitable range for the mold oscillation frequency is increased.

Figure 2:
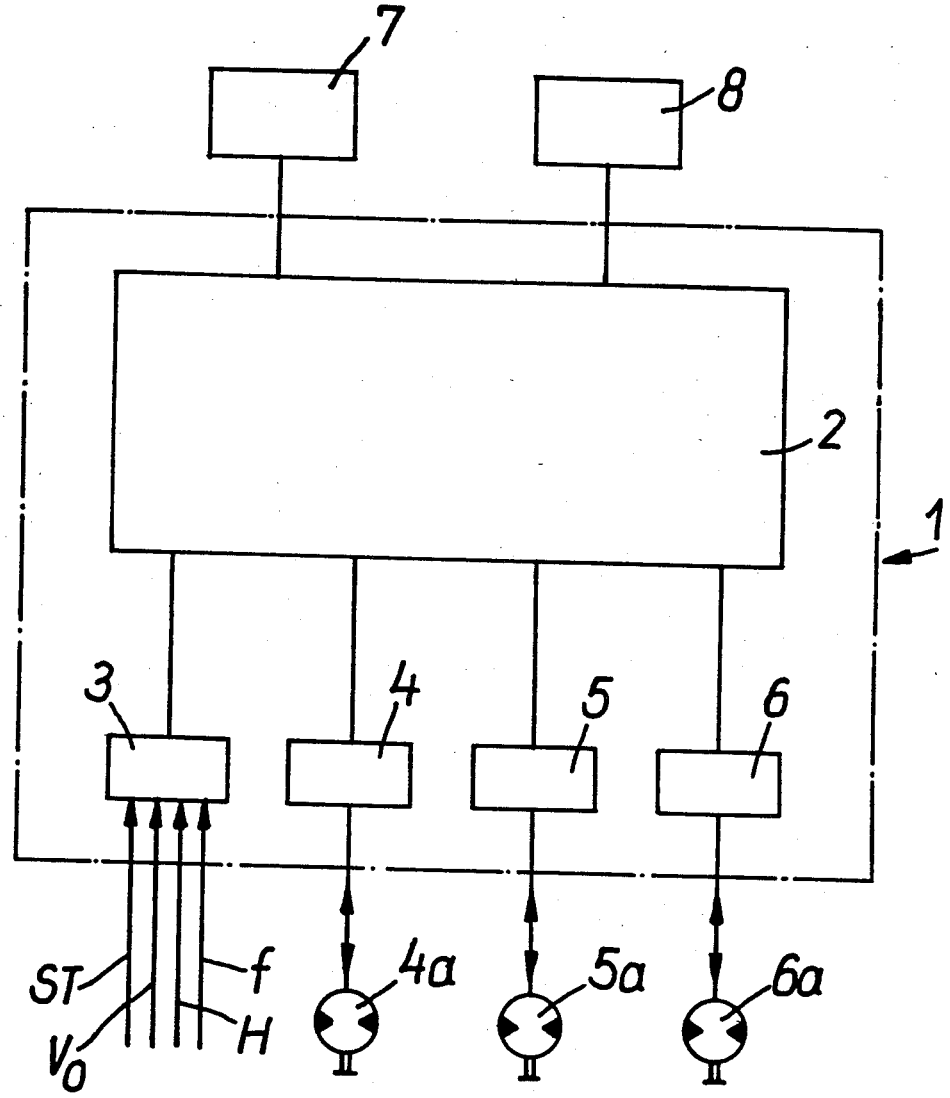
FIG. 2 shows schematically the setup of the process control system by means of which the casting rate, via the strand withdrawal drive, and the mould stroke and the mould oscillation frequency of the horizontal continuous casting mould can be adjusted and interlinked in the manner desired.

The process control system 1 (see FIG. 2) consists essentially of a central control unit 2, equipped with a process computer, an input unit 3, three input and output units 4, 5 and 6, a printer 7 for documenting process data and a display unit 8 on which can be displayed the main process parameters, particularly casting rate, mould oscillation frequency, mould stroke and the average lead.

The signals Start/Stop (ST) as well as any desired values for the casting rate ($V_o$), the mould stroke (H) and the mould oscillation frequency (f) are input into the central control unit 2 via the input unit 3.

The input and output units 4 to 6 are linked in control terms on the one hand with the strand withdrawal drive 4*a* and with the adjusting drive 5*a* for the mould stroke and with the oscillation drive 6*a* for producing the mould oscillation frequency and on the other hand with the central control unit 2; they therefore permit the operation of the process with the use of a computer program which is executed by the process computer of the central control unit 2. The central control unit performs the necessary computations and desired linking operations between the variable parameters mould oscillation frequency f, mould stroke H and casting rate $V_o$.

If, for example, a fixed value is given for the mould stroke H, the mould oscillation frequency is computed allowing for lead when the casting rate is being increased manually or automatically. Appropriate signals are transmitted via the input and output units 4 to 6 to the corresponding drives 4*a* to 6*a* so that the drives operate adjusted in the manner required.

In the embodiment in question the drives 4*a*, 5*a* and 6*a* are designed so that the casting rate $V_o$ can be adjusted in the range between 0 and 5 m/min., the mould stroke H between 0 and 6 mm and the mould oscillation frequency f between 0 and 500/min..

It will be understood that the above description of the present invention is susceptible to various modifications, changes and adaptations, and the same are intended to be comprehended within the meaning and range of equivalents of the appended claims.

What is claimed is:

1. In a method for oscillating an inherently rigid horizontal continuous casting mold for metals, by subjecting the mold to sinusoidally oscillating horizontal stroke movements alternately in the casting direction and in the direction opposite to the casting direction, while the casting is advanced in the casting direction and is removed continuously, the improvement comprising: oscillating the mold at a frequency, f, of at least about 100 cycles/minute; and giving the oscillation frequency, f, and mold stroke, H, values related to casting rate, $V_0$, such that the average value of 2 $fH/V_0$ is at least 0.64 and the displacement of the mold relative to the casting during each movement of the mold in the casting direction is no greater than 1 mm.

2. A method as defined in claim 1 wherein the displacement of the mold relative to the casting during each movement of the mold in the casting direction is between 0.1 and 0.5 mm.

3. A method as defined in claim 2 wherein the mold oscillating frequency, f, is at least 120 cycles/minute.

4. A method as defined in claim 3 wherein the mold stroke, H, is no greater than 6 mm.

5. A method as defined in claim 4 wherein the mold stroke, H, is no greater than 5 mm.

6. A method as defined in claim 5 wherein said step of giving is carried out by a process computer in dependence on the rate of advance of the casting for maintaining the maximum value of the displacement of the mold relative to the casting during each movement of the mold in the casting direction and the minimum average value of 2 $fH/V_0$.

7. A method as defined in claim 4 wherein said step of giving carried out by a process computer in dependence on the rate of advance of the casting for maintaining the maximum value of the displacement of the mold relative to the casting during each movement of the mold in the casting direction and the minimum average value of 2 $fH/V_0$.

8. A method as defined in claim 3 wherein said step of giving is carried out by a process computer in dependence on the rate of advance of the casting for maintaining the maximum value of the displacement of the mold relative to the casting during each movement of the mold in the casting direction and the minimum average value of 2 $fH/V_0$.

9. A method as defined in claim 2 wherein the mold stoke, H, is no greater than 6 mm.

10. A method as defined in claim 2 wherein the mold stroke, H, is no greater than 5 mm.

11. A method as defined in claim 2 wherein said step of giving is carried out by a process computer in dependence on the rate of advance of the casting for maintaining the maximum value of the displacement of the mold relative to the casting during each movement of the mold in the casting direction and the minimum average value of 2 $fH/V_0$.

12. A method as defined in claim 1 wherein the mold oscillating frequency, f, is at least 120 cycles/minute.

13. A method as defined in claim 1 wherein the mold stroke, H, is no greater than 6 mm.

14. A method as defined in claim 1 wherein the mold stroke, H, is no greater than 5 mm.

15. A method as defined in claim 1 wherein said step of giving is carried out by a process computer in dependence on the rate of advance of the casting for maintaining the maximum value of the displacement of the mold relative to the casting during each movement of the mold in the casting direction and the minimum average value of 2 $fH/V_0$.

* * * * *